United States Patent [19]

Turver

[11] Patent Number: 4,819,666

[45] Date of Patent: Apr. 11, 1989

[54] SMOKE-LESS CIGARETTE CONTAINER

[76] Inventor: Carlos S. Turver, Circunvalacion Providencia, 1105, Sector Hidalgo, Guadalajara, Jalisco, Mexico

[21] Appl. No.: 82,781

[22] Filed: Aug. 6, 1987

[51] Int. Cl.[4] ..... A24F 7/04

[52] U.S. Cl. ..... 131/175; 131/187; 131/190

[58] Field of Search ..... 131/175, 187, 190

[56] References Cited

U.S. PATENT DOCUMENTS

| | | | |
|---|---|---|---|
| 1,082,393 | 12/1913 | Baron | 131/175 |
| 1,485,267 | 2/1924 | Herks | 131/175 |
| 1,519,785 | 12/1924 | Luna | 131/175 |
| 2,074,466 | 3/1937 | Feuerbach | 131/10 |
| 2,191,672 | 2/1940 | Malicki | 131/182 |
| 2,237,663 | 4/1941 | Fullarton | 131/175 |
| 2,267,966 | 12/1941 | Allen | 131/175 |
| 2,502,951 | 4/1950 | Hutton | 131/178 |
| 2,681,560 | 6/1954 | Shuttleworth et al. | 70/273 |
| 2,788,005 | 4/1957 | Gustafsson | 131/175 |
| 3,424,123 | 1/1969 | Giffard | 116/2 |
| 3,827,444 | 8/1974 | Khan | 131/175 X |
| 3,861,523 | 1/1975 | Fountain et al. | 206/236 |
| 3,886,953 | 6/1975 | Pope | 131/170 A |
| 4,319,587 | 3/1982 | Moser | 131/270 |
| 4,637,407 | 1/1987 | Bonanno et al. | 131/187 X |

*Primary Examiner*—Vincent Millin
*Assistant Examiner*—Joe H. Cheng
*Attorney, Agent, or Firm*—Owen, Wickersham & Erickson

[57] ABSTRACT

A device for helping a cigarette smoker to reduce his daily cigarette consumption. An elongated container has a main body at least as long as a cigarette. The body holds an interiorly threaded cylinder and has an upper end that is exteriorly threaded. A container cap has threads engageable with the body's exterior threads. There is a serrated cup and ash holder inside the container engaging the interior threads, and a knob is provided for rotating the cylinder to cause them to go up and down in the container, depending on the direction of rotation. The main body preferably has a clip on its exterior. The device may have a lighter in an upper portion of the cap.

4 Claims, 1 Drawing Sheet

SMOKE-LESS CIGARETTE CONTAINER

This invention relates to a smoke-less cigarette container.

BACKGROUND OF THE INVENTION

Many smokers often try to reduce their consumption. However, the automatic reflex of lighting up a chain or series of cigarettes when drinking, socializing, etc., more often than not increase the smoking habit.

An object of the present invention is to provide a container which is a constant reminder to a smoker that two or three puffs are really all that are needed to fulfill the nicotine urge.

As many smokers wish to reduce their smoking habit, but not to stop it entirely, another object of the invention is to provide an instrument that can immediately reduce a twenty-cigarette-a-day smoker to only one cigarette per day or reduce a two-pack-a-day smoker to two cigarettes per day, etc.

SUMMARY OF THE INVENTION

This invention is a device for helping a cigarette smoker to reduce his daily cigarette consumption.

An elongated container has a main body with an interior opening at least as long as a cigarette. Inside the container is an interiorly threaded cylinder which has a rotatable knob that extends below the lower end of the container. The container's upper end is exteriorly threaded, and an interiorly threaded container cap engages the body's exterior threads, and, normally, closes the container. In the lower end of the cylinder is a serrated cup and ash holder which engages the cylinder's interior threads. When the rotatable knob is turned it causes the cup and ash holder to go up or down in the cylinder, depending on the direction of rotation of the knob.

A single cigarette is placed in the opening and covered by the cap. When the cap is removed, the cigarette can be taken out, lighted, smoked for a few puffs and then put back in the container and snuffed out against the cup or extinguished by lack of oxygen. The cigarette can be taken out again and again for a few puffs at a time. As the cigarette becomes shorter, the cup and ash holder are raised, so that the cigarette can be taken out when desired. When the cigarette becomes so short that it should be thrown away, it can, if desired, be snuffed out and then discarded, and the ashes in the ash holder can also be discarded. Then the cup and ash holder are lowered and a new cigarette put into the container.

The device preferably has a clip on the exterior of the main body.

The device may have a lighter in an upper portion of the cap.

In summary, smoking one cigarette several times by extinguishing and relighting it as many as twenty times, serves to provide the believed-to-be-needed nicotine without having the user having to smoke an entire pack of twenty cigarettes. The device is economical, as only one cigarette is smoked instead of twenty.

The device is also healthy, as most smokers consume an entire cigarette due to habit, not due to need. Two or three puffs is enough to satisfy nicotine needs.

The device is clean, as ashes are stored in the cup of a serrated ash holder, and the cigarette butt remains in the container until it and the ashes are discarded in an appropriate place, so that no ashtray is needed.

The container is easy to carry, as it clips onto a shirt or blouse pocket and is less of a nuisance than carrying a full pack plus a separate lighter.

DESCRIPTION OF A PREFERRED EMBODIMENT

Figure 1:
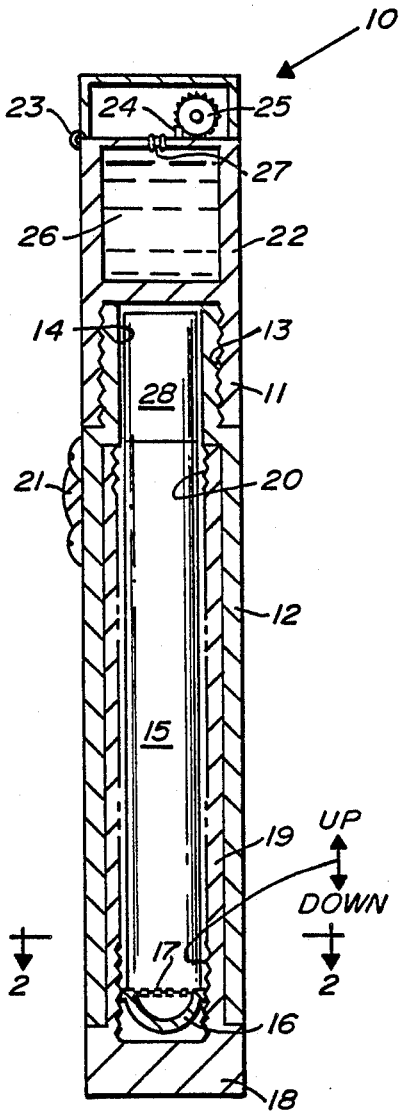
FIG. 1 is a view in elevation and in section of a container embodying the principles of the invention as applied to a one-pack-a-day smoker.
Figure 2:
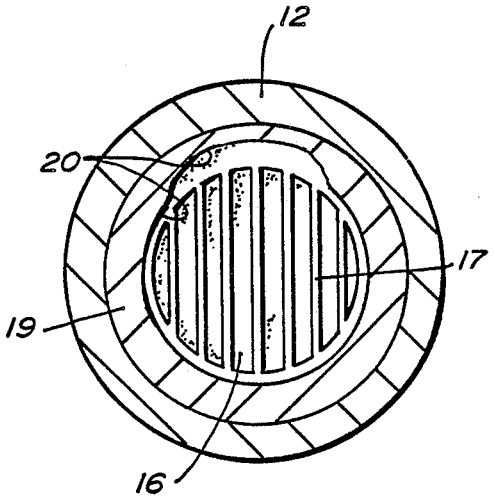
FIG. 2 is a view in section taken along the line 2—2 in FIG. 1.

The embodiment shown in FIGS. 1 and 2 comprises a container 10 having a cap 11 which is threaded to a main body 12 by threads 13 so that it can be unthreaded and opened. Normally, it is kept closed. The main body 12 may be of plastic or metal or other suitable material, and is tubular so that it provides a long central opening 14, which is able to accept the full length of a cigarette 15. At its lower end, a cup portion 16 provides a serrated ash holder 17; exteriorly there is a knob 18 connected to an interior by a threaded lining member 19. The knob can be rotated to raise or lower the cup 16 and the ash holder 17. The interior wall of the cylindrical lining member 19 has a spiral thread 20, in which the ash holder 17 rides. Basically, the arrangement is like that of a mechanical pencil or a lipstick holder.

The exterior of the body 12 includes a clip 21 which may be used to hold the container 10 in one's shirt pocket or blouse pocket.

The cap 11 may be short and simply serve to close the opening 14, or it may, as shown in FIG. 1, also include a cigarette lighter 22 having a hinge 23, a flint 24, and a flint wheel 25. The lighter 22 may be provided with fuel 26 and has a gas opening 27.

In utilization, the threaded cap 11 is twisted counterclockwise to separate it from the base or body 12. Then a cigarette 15, which may have a filter 28, is inserted into the opening 14 and down into the liner 19. When the base knob 18 is turned clockwise, the serrated ash holder 17 rises on the spiral threads 20 to meet the head of the cigarette 15. Once this adjustment is made, the cigarette filter 28 protrudes from the opening 14, so that it can be grasped by the fingers or lips and easily removed from the base or body 12 of the container 10.

The container 10 is secured to a shirt or blouse pocket by the clip 21. When smoking is desired, the container 10 is lifted at the cap 11 from the pocket by the fingers of the right hand. Once removed, the container base 12 may be grasped and held firmly by the fingers of the left hand. The right hand twists the cap to the left, and the threads 13 are disengaged so that separation of the base 12 and the cap 11 is possible. The left hand may then raise the base 12 to enable the smoker to grasp the filter 28 with his lips, teeth, or the free fingers of his right hand and to extract the cigarette 15 from the container 10. Once the cigarette 15 is in his mouth, his right hand may manipulate the lighter 22 to strike a flame and light the cigarette 15. A match may, of course, be used instead. The container 10 is then reassembled and reclipped to the smoker's clothing.

After the user has smoked as much of a given cigarette 15 as he desires—usually only two or three puffs—the container 10 is re-opened, if it was closed, and the lighted cigarette 15 is reinserted through the opening 14 into the base 12 of the container 10. The lighted end of the cigarette 15 rests in the serrated ash holder 17 and is extinguished by both pressure and lack of oxygen. The ashes remain in the cup 16 of the serrated ash holder 17.

The identical process is repeated each time the smoker feels a need for nicotine.

As a given single cigarette 15 is partially smoked, it obviously shortens, and the serrated ash holder 17 and knob 18 is twisted clockwise each time to accommodate the new shortened length. This adjustment allows the user to grasp the filter end 28 of the cigarette 15 easily when the container 10 is opened.

When one cigarette 15 has been smoked to the desired length, the filter 28 and ashes are discarded. The serrated ash holder knob 18 then is turned counter clockwise, expanding the container opening 14 to accommodate a fresh cigarette.

If desired, extra tubes may be added to the side of the container to store two or three additional cigarettes for the two- or three-pack-a-day smoker.

The container may also be modified in size for cigar use, using the ideas already described.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A device for helping a cigarette smoker to reduce his daily cigarette consumption, including in combination:

an elongated container having a main body holding interiorly helically threaded means in an elongated opening at least as long as a cigarette and an upper end that is exteriorly threaded, a container cap having threads engageable with the body's exterior threads for closing the container, a serrated cup and ash holder in said container engaging said interior threads, and a knob connected to said interiorly threaded means for rotating said means and thereby causing said cup and ash holder to go up or down in said container, depending on the direction of rotation.

2. The device of claim 1 having a lighter in an upper portion of said cap.

3. The device of claim 1 having a clip on the exterior of said main body.

4. A device for helping a cigarette smoker to reduce his daily cigarette consumption, including in combination:

an elongated container having a main body with an opening at least as long as a cigarette and an upper end that is exteriorly threaded, an interiorly helically threaded cylindrical liner in said container having a rotatable knob below said main body, a container cap having threads engageable with the body's exterior threads for closing the container, and a serrated cup and ash holder in said container engaging said interior threads, said knob, when rotated, causing said cup and ash holder to go up or down in said container, depending on the direction of rotation.

* * * * *